US009068726B2

(12) United States Patent
Zhang

(10) Patent No.: US 9,068,726 B2
(45) Date of Patent: Jun. 30, 2015

(54) SPOTLIGHT

(71) Applicant: GEMMY INDUSTRIES CORPORATION, Coppell, TX (US)

(72) Inventor: Cheng-Chun Zhang, Shenzhen (CN)

(73) Assignee: Gemmy Industries Corp., Coppell, TX (US)

( * ) Notice: Subject to any disclaimer, the term of this patent is extended or adjusted under 35 U.S.C. 154(b) by 0 days.

(21) Appl. No.: 14/079,628

(22) Filed: Nov. 13, 2013

(65) Prior Publication Data

US 2015/0131288 A1 May 14, 2015

(51) Int. Cl.

| | |
|---|---|
| ***F21V 14/06*** | (2006.01) |
| ***F21S 8/00*** | (2006.01) |
| ***F21V 5/04*** | (2006.01) |

(52) U.S. Cl.

CPC . *F21V 14/06* (2013.01); *F21S 8/00* (2013.01); *F21V 5/04* (2013.01)

(58) Field of Classification Search

CPC ..... F21S 8/081; F21S 8/083; F21S 10/007; F21V 1/10; F21V 5/002; F21V 14/06; F21V 33/006; F21W 2131/107; F21W 2131/109

See application file for complete search history.

(56) References Cited

U.S. PATENT DOCUMENTS

| | | | | |
|---|---|---|---|---|
| 3,263,069 | A * | 7/1966 | Krucki et al. | 362/431 |
| 4,870,548 | A * | 9/1989 | Beachy et al. | 362/145 |
| 6,786,793 | B1 | 9/2004 | Wang | |
| 7,033,037 | B2 | 4/2006 | Chen | |
| 7,063,553 | B1 * | 6/2006 | Mullen | 439/336 |
| 7,320,533 | B1 * | 1/2008 | Beadle | 362/285 |
| 8,262,252 | B2 * | 9/2012 | Bergman et al. | 362/237 |
| 2003/0231497 | A1 | 12/2003 | Sakata et al. | |
| 2005/0243560 | A1 | 11/2005 | Chen | |
| 2007/0097681 | A1 | 5/2007 | Chich et al. | |
| 2009/0122548 | A1 * | 5/2009 | Dalsgaard | 362/282 |
| 2009/0268466 | A1 * | 10/2009 | Allegri | 362/268 |
| 2010/0091491 | A1 | 4/2010 | Jiang et al. | |
| 2011/0194292 | A1 | 8/2011 | Tsai | |
| 2011/0286200 | A1 | 11/2011 | Iimura et al. | |
| 2012/0147609 | A1 | 6/2012 | Black et al. | |
| 2012/0182743 | A1 | 7/2012 | Chou | |
| 2012/0300429 | A1 | 11/2012 | Jin | |
| 2013/0094193 | A1 * | 4/2013 | Baxter et al. | 362/184 |
| 2014/0001507 | A1 * | 1/2014 | Streppel et al. | 257/98 |

OTHER PUBLICATIONS

Office Action issued Feb. 26, 2015 in U.S. Appl. No. 14/145,512.
Office Action issued Apr. 9, 2015 in U.S. Appl. No. 14/098,594.

* cited by examiner

*Primary Examiner* — Julie Bannan
(74) *Attorney, Agent, or Firm* — Venable LLP; Steven J. Schwarz

(57) ABSTRACT

A spotlight has a light base, a supporting base, a power supply, a motor, a lighting module, a multi-surface refractive lens and a beam-splitter lens light shade. The supporting base is connected with the light base. The power supply, the motor, the lighting module, and the multi-surface refractive lens are mounted in the light base. The lighting module has multiple light emitting diode units facing the multi-surface refractive lens. The multi-surface refractive lens is mounted around a motor shaft of the motor. The beam-splitter lens light shade is mounted on the light base and has multiple multi-angle refractive convex-lens bodies facing the multi-surface refractive lens.

16 Claims, 4 Drawing Sheets

SPOTLIGHT

BACKGROUND OF THE INVENTION

1. Field of the Invention

The present invention relates to a spotlight, and more particularly to a spotlight that has a dynamic and cloud-like lighting effect.

2. Description of Related Art

A spotlight is often applied for stages to create a vibrant atmosphere. A conventional spotlight has a motor and a projection lamp. The projection lamp has a shell, a lighting module, and a lens. The lighting module and the lens are mounted in the shell. The lighting module emits light beams toward the lens to be refracted. The motor can drive the projection lamp to rotate or to swing to create different lighting effects.

However, the light beams refracted from the lighting lamp cannot be projected outwards at different angles covering a large area. Therefore, the lighting effect of the conventional spotlight is monotonous.

SUMMARY OF THE INVENTION

The main objective of the present invention is to provide a spotlight to resolve the mentioned problem.

The spotlight has a light base, a supporting base, a power supply, a motor, a lighting module, a multi-surface refractive lens, and a beam-splitter lens light shade.

The light base is hollow and has an opening formed in an end of the light base. The supporting base is connected with a bottom of the light base. The power supply is mounted in the light base and has a power cord extending out of the light base. The motor is mounted in the light base, is electrically connected with the power supply, and has a motor shaft extending toward the opening of the light base. The lighting module is mounted in the light base, is located at a side of the motor adjacent to the opening of the light base, and has a circuit board and multiple light emitting diode units. The circuit board is mounted around but does not touch the motor shaft, is electrically connected with the power supply, and has a board hole formed through the circuit board, wherein the circuit board is mounted around the motor shaft via the board hole. The light emitting diode units are electrically mounted on a side of the circuit board adjacent to the opening of the light base. The multi-surface refractive lens is rotatably mounted in the light base, is fixed around the motor shaft, is located at a side of the lighting module adjacent to the opening of the light base, and has multiple multi-angle refractive convex-lens bodies formed on a side of the multi-surface refractive lens that is distal from the lighting module. The beam-splitter lens light shade is mounted on the opening of the light base and has multiple multi-angle refractive convex-lens bodies formed on a side of the beam-splitter lens light shade facing the multi-surface refractive lens.

Other objectives, advantages and novel features of the present invention will become more apparent from the following detailed description when taken in conjunction with the accompanying drawings.

DETAILED DESCRIPTION OF PREFERRED EMBODIMENT

Figure 1:
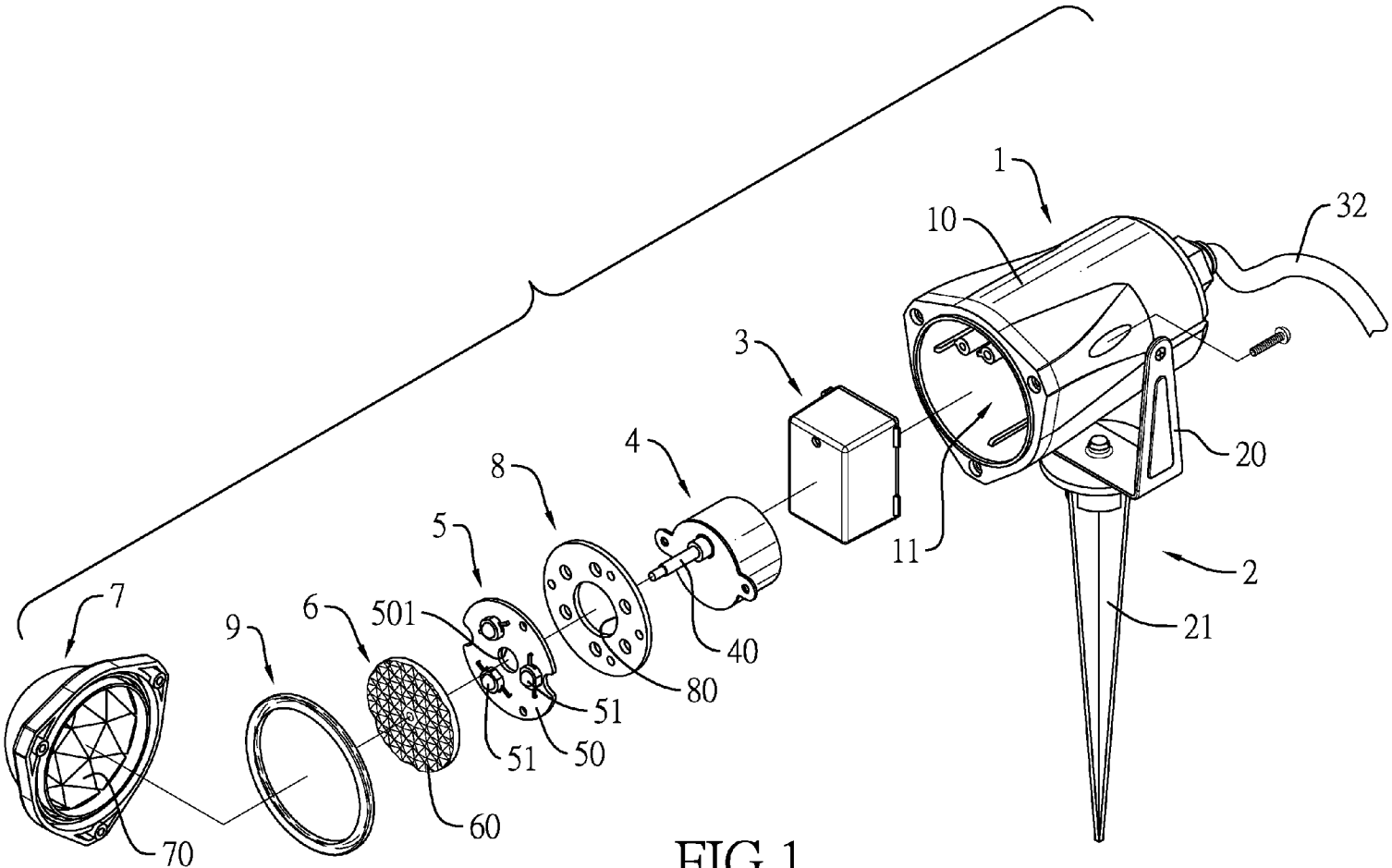
FIG. 1 is an exploded perspective view of a preferred embodiment of a spotlight in accordance with the present invention.
Figure 2:
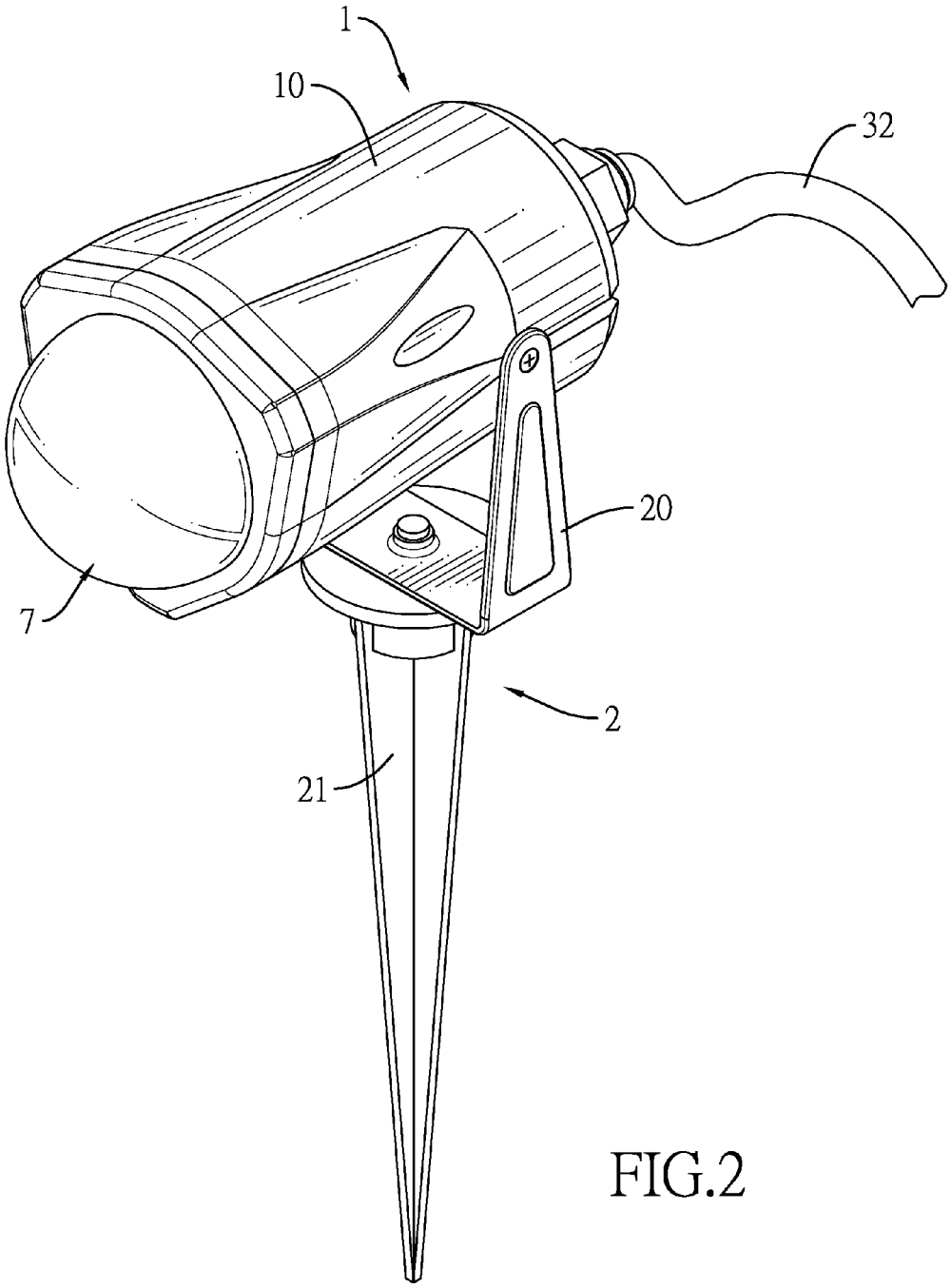
FIG. 2 is a perspective view of the spotlight in FIG. 1.
Figure 3:
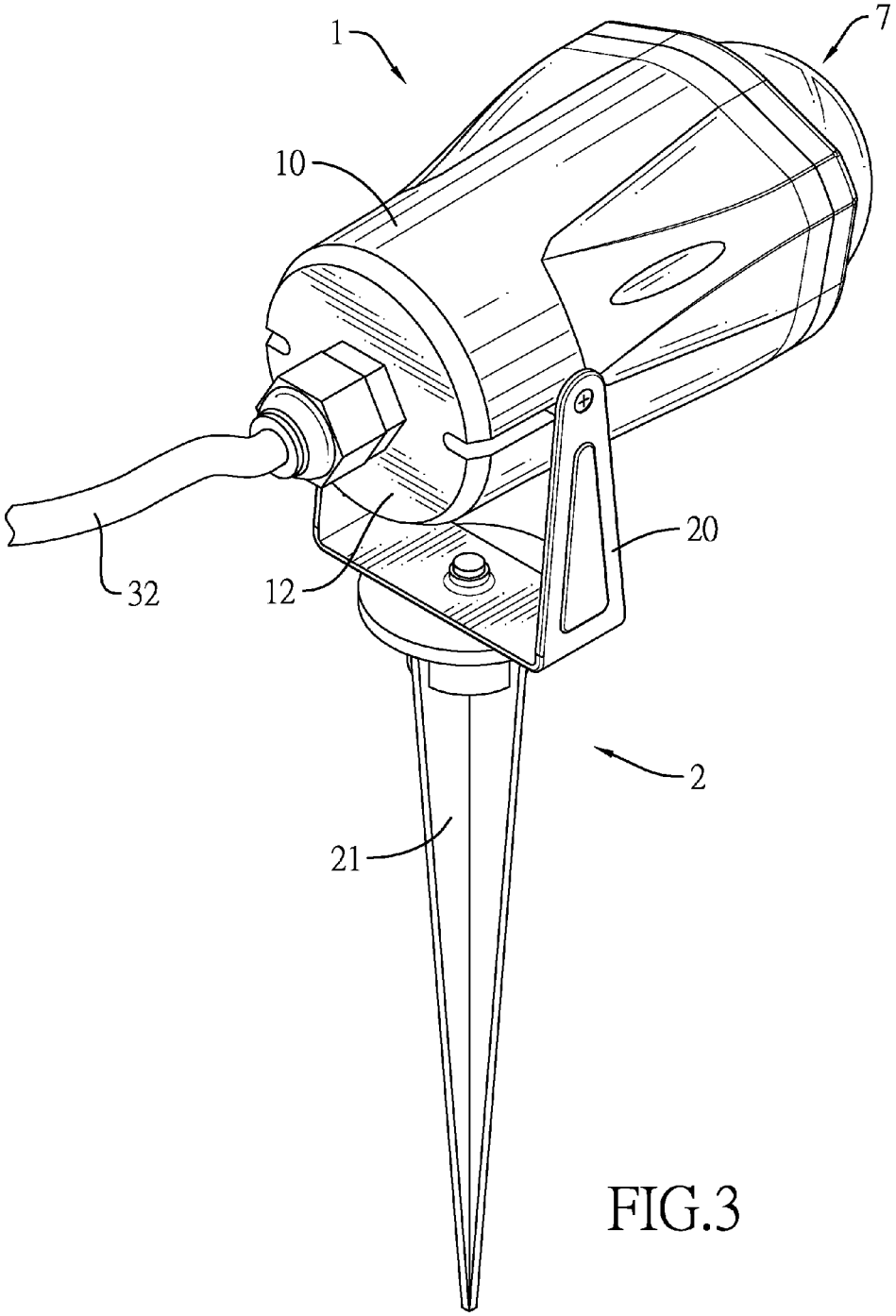
FIG. 3 is another perspective view of the spotlight in FIG. 1.

With reference to FIGS. 1 to 3, a preferred embodiment of a spotlight in accordance with the present invention has a light base 1, a supporting base 2, a power supply 3, a motor 4, a lighting module 5, an insulating panel 8, a multi-surface refractive lens 6, a beam-splitter lens light shade 7, and a waterproof washer 9.

The light base 1 is hollow and has a periphery 10, a base space 11, a closure plate 12, and an opening. The base space 11 is formed through the light base 1 and surrounded by the periphery 10. The closure plate 12 is mounted on a rear end of the periphery 10 and shelters the base space 11. The opening is formed in a front end of the periphery 10 and communicates with the base space 11.

The supporting base 2 is mounted on a bottom of the light base 1 to support the light base 1. The supporting base 2 has a supporting frame 20 and a grounding stick 21. The supporting frame 20 may be U-shaped. Two ends of the supporting frame 20 are pivotally connected with the periphery 10, such that the light base 1 can be pivoted relative to the supporting base 2 to adjust an inclined angle of the light base 1. The grounding stick 21 is tapered and is rotatably connected with a middle of a bottom of the supporting frame 20, such that the light base 1 can be rotated relative to the supporting base 2.

Figure 4:
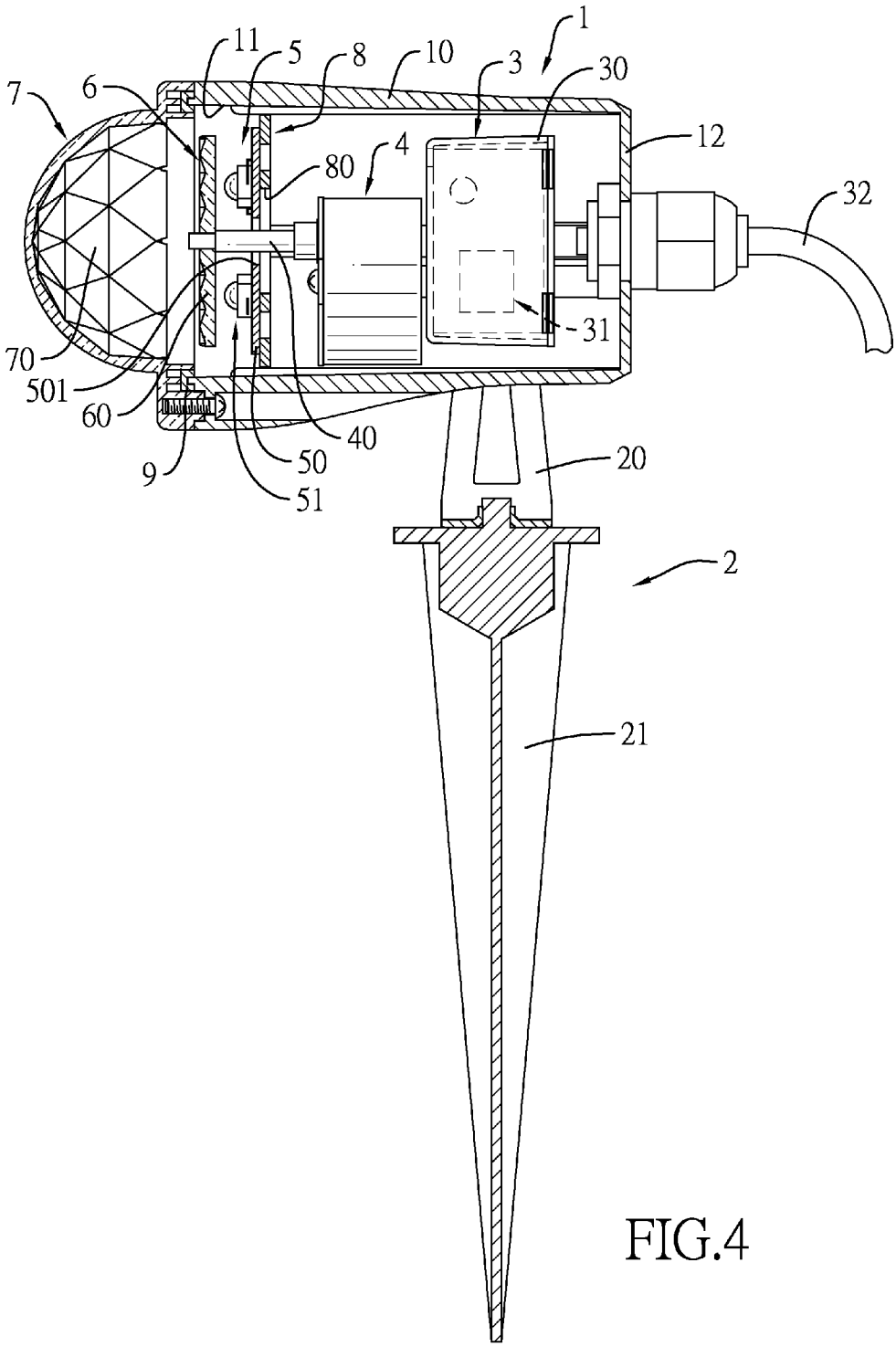
FIG. 4 is a side view in partial section of the spotlight in FIG. 1.

With reference to FIGS. 1 and 4, the power supply 3 is mounted in the base space 11 and has a box 30, a power adapter 31, and a power cord 32. The box 30 is hollow and is mounted in the base space 11. The power adapter 31 is mounted in the box 30 and can convert alternating currents to direct currents. The power cord 32 is electrically connected with the power adapter 31, is mounted through the closure plate 12 and is connected with an external power source.

The motor 4 is mounted in the base space 11, is electrically connected with the power adapter 31 and has a motor shaft 40 extending toward the opening of the light base 1.

The lighting module 5 is mounted in the base space 11, is located at a front of the motor 4, is mounted around the motor shaft 40 and has a circuit board 50 and multiple light emitting diode units 51. The circuit board 50 is electrically connected with the power adapter 31 and has a board hole 501 formed through the circuit board 50. The circuit board 50 is mounted around the motor shaft 40 via the board hole 501 but does not touch the motor shaft 40. The light emitting diode units 51 can emit light beams in different colors and are electrically mounted on a side of the circuit board 50 that is distal from the motor 4. The circuit board 50 can control a light mode of the light emitting diode units 51, such as a flicker mode or a normal mode. The power adapter 31 provides power for the lighting module 5 and the motor 4.

The insulating panel 8 is mounted between the lighting module 5 and the motor 4 to keep the motor 4 from being affected by high temperature generated by the operating light emitting diode units 51. The insulating panel 8 may be fixed in the light base 1 on a side of the circuit board 50 facing the motor 4 or on a side of the motor 4 facing the circuit board 50. Preferably, the insulating panel 8 has a panel hole 80 formed through the insulating panel 8. The insulating panel 8 is mounted around the motor shaft 40 via the panel hole 80 and is fixed on the side of the circuit board 50 facing the motor 4.

The multi-surface refractive lens 6 is rotatably mounted in the base space 11, is mounted around and fixed on the motor shaft 40, and is located at a front of the lighting module 5. The multi-surface refractive lens 6 has multiple multi-angle refractive convex-lens bodies 60 formed on a front side of the multi-surface refractive lens 6 that is distal from the lighting module 5. The multi-surface refractive lens 6 can be driven to rotate by the motor shaft 40 of the motor 4.

The beam-splitter lens light shade 7 is mounted on the opening of the light base 1. The beam-splitter lens light shade 7 may be engaged with, adhered to, or combined via threads with the light base 1. The beam-splitter lens light shade 7 is hemispherical and has multiple multi-angle refractive convex-lens bodies 70 formed on a rear side of the beam-splitter lens light shade 7 facing the multi-surface refractive lens 6.

The waterproof washer 9 is mounted between the beam-splitter lens light shade 7 and the opening of the light base 1 to keep moisture from entering the base space 11.

With reference to FIG. 4, in use, the supporting base 2 is fixed in a ground or any other object. The power cord 32 is electrically connected with an external power source, and the power adapter 31 can convert the alternating current from the external power source to direct current for supplying power to the motor 4 and the lighting module 5. Then, the light emitting diode units 51 can emit light beams in different colors to project through the multi-angle refractive convex-lens bodies 60 of the multi-surface refractive lens 6.

In the meantime, the multi-surface refractive lens 6 is driven to rotate by the motor shaft 40 of the motor 4. When light projects through the multi-surface refractive lens 6, the light may be refracted again or be further mixed to form light beams in various colors.

Furthermore, the light beams (monochromatic or multi-chromatic) further pass through the multi-angle refractive convex-lens bodies 70 of the beam-splitter lens light shade 7, and are further refracted outwards through the beam-splitter lens light shade 7. Therefore, the light beams refracted through the beam-splitter lens light shade 7 can project outwards at different angles covering a large area. In the meantime, with the rotating multi-surface refractive lens 6 and the light emitting diode units 51 flickering with multi-chromatic light beams, the spotlight can create various and excellent lighting effects resembling kaleidoscopes, starry night sky, icing-cloud, firing-cloud, etc.

The spotlight can further be independently or combinationally applied for many extension indoor or outdoor products, such as: lamp enclosures, textile costumes, inflatable costumes, inflatable character modeling objects, or rear projection enclosures. In terms of lamp enclosure, the spotlights can be mounted inside of an enclosure with translucency or semi-translucency yielding outwardly projected patterns or rear-projected patterns upon the enclosure. In terms of textile or inflatable costumes, the spotlights can be mounted inside of or tangent to the costumes of different shapes. In terms of character modeling objects, a spotlight or multiples of spotlights can be mounted in character modeling objects that have different shapes, such as: realistic, cartoon, or abstract characters or other shaped renditions of a single or multiple characters. In terms of the rear projected patterns upon translucent or semi-translucent enclosure, at least one spotlight that is mounted inside of the enclosure can yield projected patterns and or rear-projected patterns upon the enclosure.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A spotlight having:

a light base being hollow and having an opening formed in an end of the light base;

a supporting base connected with a bottom of the light base;

a power supply mounted in the light base and having a power cord extending out of the light base;

a motor mounted in the light base, the motor electrically connected with the power supply and having a motor shaft extending toward the opening of the light base;

a lighting module mounted in the light base, the lighting module located at a side of the motor adjacent to the opening of the light base and having a circuit board mounted around but not touching the motor shaft, the circuit board electrically connected with the power supply and having a board hole formed through the circuit board, wherein the circuit board is mounted around the motor shaft via the board hole; and multiple light emitting diode units electrically mounted on a side of the circuit board adjacent to the opening of the light base;

a multi-surface refractive lens rotatably mounted in the light base, the multi-surface refractive lens fixed around the motor shaft, located at a side of the lighting module adjacent to the opening of the light base, and having multiple multi-angle refractive convex-lens bodies formed on a side of the multi-surface refractive lens that is distal from the lighting module; and a beam-splitter lens light shade mounted on the opening of the light base and having multiple multi-angle refractive convex-lens bodies formed on a side of the beam-splitter lens light shade facing the multi-surface refractive lens.

2. The spotlight as claimed in claim 1, wherein the beam-splitter lens light shade is hemispherical.

3. The spotlight as claimed in claim 2 further having an insulating panel mounted between the lighting module and the motor and having a panel hole formed through the insulating panel, wherein the insulating panel is mounted around the motor shaft via the panel hole.

4. The spotlight as claimed in claim 3 further having a waterproof washer mounted between the beam-splitter lens light shade and the opening of the light base.

5. The spotlight as claimed in claim 1, wherein the light base has a periphery;

a base space formed through the light base and surrounded by the periphery, wherein the opening is formed in an end of the periphery and communicates with the base space; and a closure plate mounted on an end of the periphery opposite to the opening and sheltering the base space; wherein the power supply, the motor, the lighting module, and the multi-surface refractive lens are mounted in the base space; and the power cord of the power supply is mounted through the closure plate.

6. The spotlight as claimed in claim 2, wherein the light base has a periphery;

a base space formed through the light base and surrounded by the periphery, wherein the opening is formed in an end of the periphery and communicates with the base space; and a closure plate mounted on an end of the periphery opposite to the opening and sheltering the base space; wherein the power supply, the motor, the lighting module, and the multi-surface refractive lens are mounted in the base space; and the power cord of the power supply is mounted through the closure plate.

7. The spotlight as claimed in claim 3, wherein the light base has a periphery;

a base space formed through the light base and surrounded by the periphery, wherein the opening is formed in an end of the periphery and communicates with the base space; and a closure plate mounted on an end of the periphery opposite to the opening and sheltering the base space; wherein the power supply, the motor, the lighting module, and the multi-surface refractive lens are mounted in the base space; and the power cord of the power supply is mounted through the closure plate.

8. The spotlight as claimed in claim 4, wherein the light base has a periphery;

a base space formed through the light base and surrounded by the periphery, wherein the opening is formed in an end of the periphery and communicates with the base space; and a closure plate mounted on an end of the periphery opposite to the opening and sheltering the base space; wherein the power supply, the motor, the lighting module, and the multi-surface refractive lens are mounted in the base space; and the power cord of the power supply is mounted through the closure plate.

9. The spotlight as claimed in claim 1, wherein the supporting base has a supporting frame being U-shaped and having two ends pivotally mounted on the light base; and a grounding stick being tapered and rotatably connected with a middle of a bottom of the supporting frame.

10. The spotlight as claimed in claim 2, wherein the supporting base has a supporting frame being U-shaped and having two ends pivotally mounted on the light base; and a grounding stick being tapered and rotatably connected with a middle of a bottom of the supporting frame.

11. The spotlight as claimed in claim 3, wherein the supporting base has a supporting frame being U-shaped and having two ends pivotally mounted on the light base; and a grounding stick being tapered and rotatably connected with a middle of a bottom of the supporting frame.

12. The spotlight as claimed in claim 4, wherein the supporting base has a supporting frame being U-shaped and having two ends pivotally mounted on the light base; and a grounding stick being tapered and rotatably connected with a middle of a bottom of the supporting frame.

13. The spotlight as claimed in claim 5, wherein the supporting base has a supporting frame being U-shaped and having two ends pivotally mounted on the periphery; and a grounding stick being tapered and rotatably connected with a middle of a bottom of the supporting frame.

14. The spotlight as claimed in claim 6, wherein the supporting base has a supporting frame being U-shaped and having two ends pivotally mounted on the periphery; and a grounding stick being tapered and rotatably connected with a middle of a bottom of the supporting frame.

15. The spotlight as claimed in claim 7, wherein the supporting base has a supporting frame being U-shaped and having two ends pivotally mounted on the periphery; and a grounding stick being tapered and rotatably connected with a middle of a bottom of the supporting frame.

16. The spotlight as claimed in claim 8, wherein the supporting base has a supporting frame being U-shaped and having two ends pivotally mounted on the periphery; and a grounding stick being tapered and rotatably connected with a middle of a bottom of the supporting frame.

* * * * *